US011708758B2

(12) United States Patent
Jabari et al.

(10) Patent No.: US 11,708,758 B2
(45) Date of Patent: Jul. 25, 2023

(54) HYDROCARBON WELLS AND METHODS OF PROBING A SUBSURFACE REGION OF THE HYDROCARBON WELLS

(71) Applicant: ExxonMobil Technology and Engineering Company, Spring, TX (US)

(72) Inventors: Rami Jabari, The Woodlands, TX (US); P. Matthew Spiecker, Manvel, TX (US); Michael C. Romer, The Woodlands, TX (US)

(73) Assignee: ExxonMobil Technology and Engineering Comany, Spring, TX (US)

( * ) Notice: Subject to any disclaimer, the term of this patent is extended or adjusted under 35 U.S.C. 154(b) by 95 days.

(21) Appl. No.: 17/018,722

(22) Filed: Sep. 11, 2020

(65) Prior Publication Data

US 2021/0123341 A1 Apr. 29, 2021

Related U.S. Application Data

(60) Provisional application No. 62/927,090, filed on Oct. 28, 2019.

(51) Int. Cl.

| | |
|---|---|
| ***E21B 47/12*** | (2012.01) |
| ***E21B 47/09*** | (2012.01) |
| ***E21B 47/26*** | (2012.01) |
| ***E21B 49/08*** | (2006.01) |

(52) U.S. Cl.

CPC ..... *E21B 47/138* (2020.05); *E21B 47/09* (2013.01); *E21B 47/26* (2020.05); *E21B 49/0875* (2020.05)

(58) Field of Classification Search

CPC ..... E21B 47/09; E21B 47/12; E21B 47/26; E21B 49/0875

See application file for complete search history.

(56) References Cited

U.S. PATENT DOCUMENTS

| | | | | |
|---|---|---|---|---|
| 6,241,028 | B1 * | 6/2001 | Bijleveld | E21B 47/00 175/40 |
| 6,443,228 | B1 * | 9/2002 | Aronstam | E21B 47/12 73/152.55 |
| 8,464,581 | B2 * | 6/2013 | Rytlewski | E21B 47/11 73/152.29 |
| 9,250,339 | B2 * | 2/2016 | Ramirez | E21B 47/12 |

(Continued)

FOREIGN PATENT DOCUMENTS

| | | | | |
|---|---|---|---|---|
| WO | WO-0104460 | A1 * | 1/2001 | E21B 47/00 |

*Primary Examiner* — Jennifer H Gay

(74) *Attorney, Agent, or Firm* — ExxonMobil Technology and Engineering Company—Law Department

(57) ABSTRACT

Hydrocarbon wells and methods of probing a subsurface region of the hydrocarbon wells. The hydrocarbon wells include a wellbore, a downhole sensor storage structure, and a detection structure. The wellbore may extend within a subsurface region and between a surface region and a downhole end region. The downhole sensor storage structure is configured to release a flowable sensor into a wellbore fluid that extends within the wellbore, and the flowable sensor may be configured to collect sensor data indicative of at least one property of the subsurface region. The detection structure may be configured to query the flowable sensor to determine the at least one property of the subsurface region. The methods include releasing a flowable sensor, collecting sensor data with the flowable sensor, and querying the flowable sensor.

26 Claims, 3 Drawing Sheets

(56) References Cited

U.S. PATENT DOCUMENTS

| | | | | |
|---|---|---|---|---|
| 9,739,141 | B2 * | 8/2017 | Zeng | E21B 47/13 |
| 10,394,193 | B2 * | 8/2019 | Li | G05B 15/02 |
| 11,125,046 | B2 * | 9/2021 | Li | E21B 33/13 |
| 11,230,918 | B2 * | 1/2022 | Gooneratne | E21B 23/00 |
| 11,261,678 | B2 * | 3/2022 | Li | E21B 21/003 |
| 11,261,692 | B2 * | 3/2022 | Li | E21B 21/003 |
| 2002/0185273 | A1 * | 12/2002 | Aronstam | E21B 47/138 166/250.01 |
| 2010/0122813 | A1 * | 5/2010 | Trummer | E21B 33/138 166/255.1 |
| 2011/0191028 | A1 * | 8/2011 | Ross | E21B 47/01 702/6 |
| 2011/0277544 | A1 * | 11/2011 | Rytlewski | E21B 47/11 73/152.18 |
| 2013/0118733 | A1 * | 5/2013 | Kumar | E21B 41/0085 166/254.2 |
| 2016/0115783 | A1 * | 4/2016 | Zeng | E21B 47/26 340/854.4 |
| 2016/0319659 | A1 * | 11/2016 | Molenaar | E21B 43/26 |
| 2017/0322341 | A1 * | 11/2017 | Galliano | E21B 49/00 |
| 2019/0063198 | A1 * | 2/2019 | Anderson | E21B 21/00 |
| 2019/0101872 | A1 * | 4/2019 | Li | G05B 11/01 |
| 2020/0332656 | A1 * | 10/2020 | Jacob | H04L 67/12 |
| 2020/0362693 | A1 * | 11/2020 | Ahmadian-Tehrani | E21B 43/14 |
| 2021/0123341 | A1 * | 4/2021 | Jabari | E21B 47/00 |
| 2021/0131270 | A1 * | 5/2021 | Bezerra De Melo | E21B 47/12 |
| 2021/0131275 | A1 * | 5/2021 | Romer | E21B 47/13 |
| 2021/0172269 | A1 * | 6/2021 | Li | E21B 47/12 |
| 2021/0172270 | A1 * | 6/2021 | Li | E21B 21/003 |
| 2021/0172281 | A1 * | 6/2021 | Li | E21B 21/003 |
| 2021/0189863 | A1 * | 6/2021 | Gooneratne | E21B 47/09 |
| 2021/0324702 | A1 * | 10/2021 | Li | E21B 27/02 |

* cited by examiner

HYDROCARBON WELLS AND METHODS OF PROBING A SUBSURFACE REGION OF THE HYDROCARBON WELLS

CROSS-REFERENCE TO RELATED APPLICATIONS

This application claims the benefit of U.S. Provisional Application No. 62/927,090, filed Oct. 28, 2019, the disclosure of which is herein incorporated by reference in its entirety.

FIELD OF THE INVENTION

The present disclosure relates generally to hydrocarbon wells and methods of probing a subsurface region of the hydrocarbon wells, and more particularly to hydrocarbon wells and/or methods that utilize a downhole sensor storage structure to release a flowable sensor within a downhole end region of the hydrocarbon well.

BACKGROUND OF THE INVENTION

Obstructions within a hydrocarbon well historically have been detected via comparisons between an actual production rate from the hydrocarbon well and an expected production rate from the hydrocarbon well. While effective in certain circumstances, such a detection mechanism requires a large number of assumptions and may provide very little information about a location and/or extent of the obstruction. As such, it may be difficult to select an appropriate cleanout methodology based solely on production rate data.

More invasive obstruction detection methodologies also may be utilized. These more invasive detection methodologies generally require that coiled tubing, a wireline, a workover rig with jointed pipe, and/or a slickline-attached detector be deployed within the hydrocarbon well. Such invasive detection methodologies often are costly to implement and/or only may be effective with certain obstructions, certain downhole conditions, and/or when the obstruction is less than a threshold distance from the surface. Thus, there exists a need for improved hydrocarbon wells and/or for improved methods of probing a subsurface region of the hydrocarbon wells.

SUMMARY OF THE INVENTION

Hydrocarbon wells and methods of probing a subsurface region of the hydrocarbon wells. The hydrocarbon wells include a wellbore, a downhole sensor storage structure, and a detection structure. The wellbore may extend within a subsurface region that extends between a surface region and a downhole end region of the hydrocarbon well. The downhole sensor storage structure is configured to release a flowable sensor into a wellbore fluid that extends within the wellbore, and the flowable sensor may be configured to collect sensor data indicative of at least one property of the subsurface region. The detection structure may be configured to query the flowable sensor to determine the at least one property of the subsurface region.

The methods include releasing a flowable sensor, collecting sensor data, and querying the flowable sensor. The releasing may include releasing the flowable sensor from a downhole sensor storage structure and/or into a wellbore fluid. The releasing additionally or alternatively may include releasing the flowable sensor within a downhole end region of the hydrocarbon well. The hydrocarbon well may extend between a surface region and the downhole end region. The collecting sensor data may include collecting sensor data with the to flowable sensor and may be performed subsequent to the releasing. The querying the flowable sensor may include querying to determine the at least one property of the subsurface region of the hydrocarbon well.

DETAILED DESCRIPTION OF THE INVENTION

Figure 1:
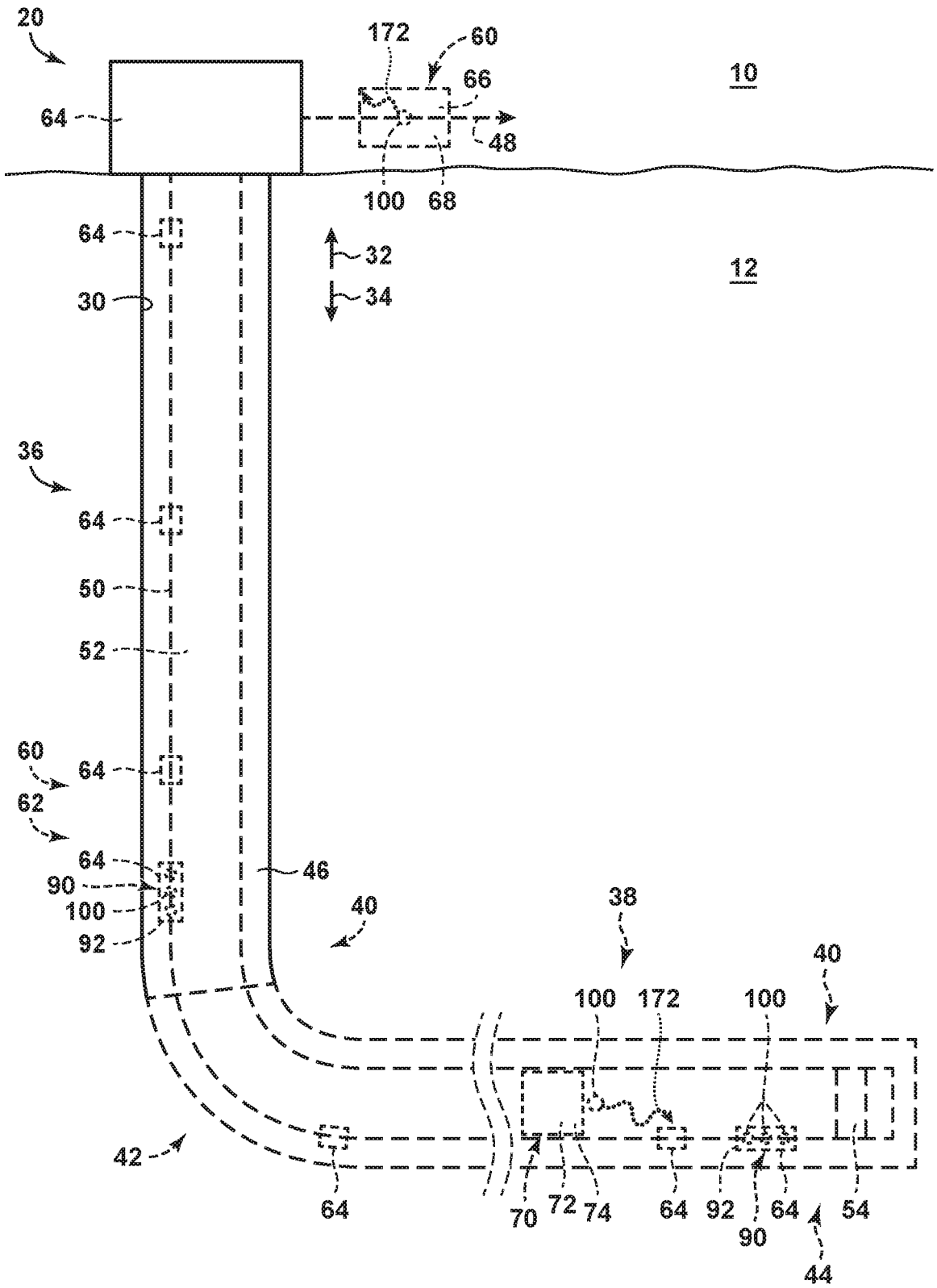
FIG. 1 is a schematic illustration of examples of a hydrocarbon well that may be utilized with methods, according to the present disclosure.
Figure 2:
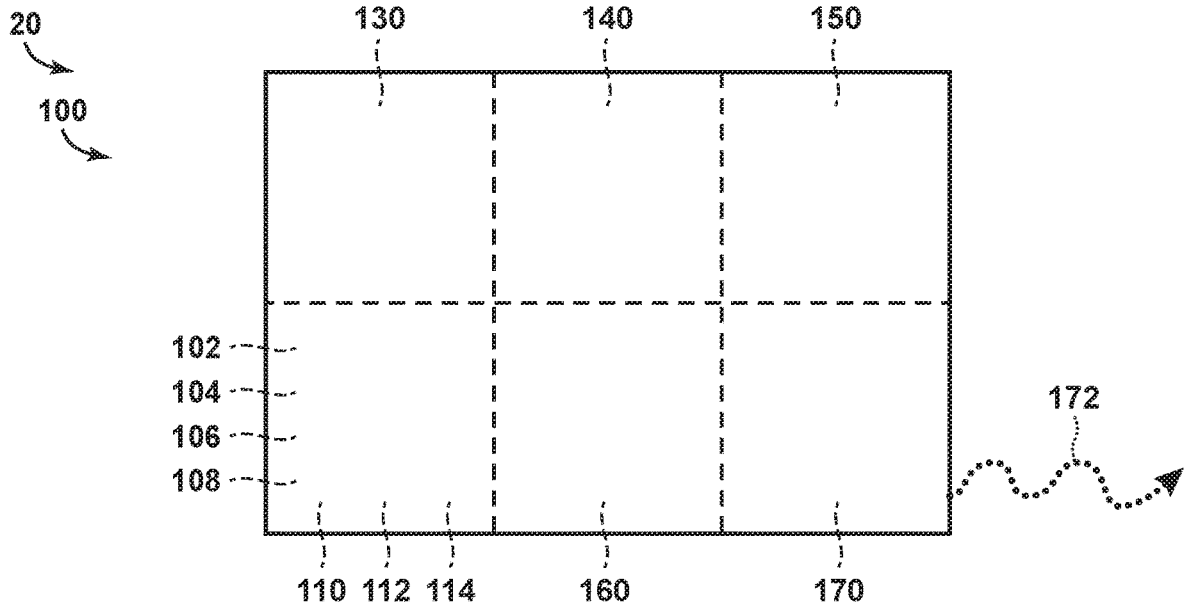
FIG. 2 is a schematic illustration of examples of flowable sensors that may be included in and/or utilized with hydrocarbon wells and/or methods, according to the present disclosure.
Figure 3:
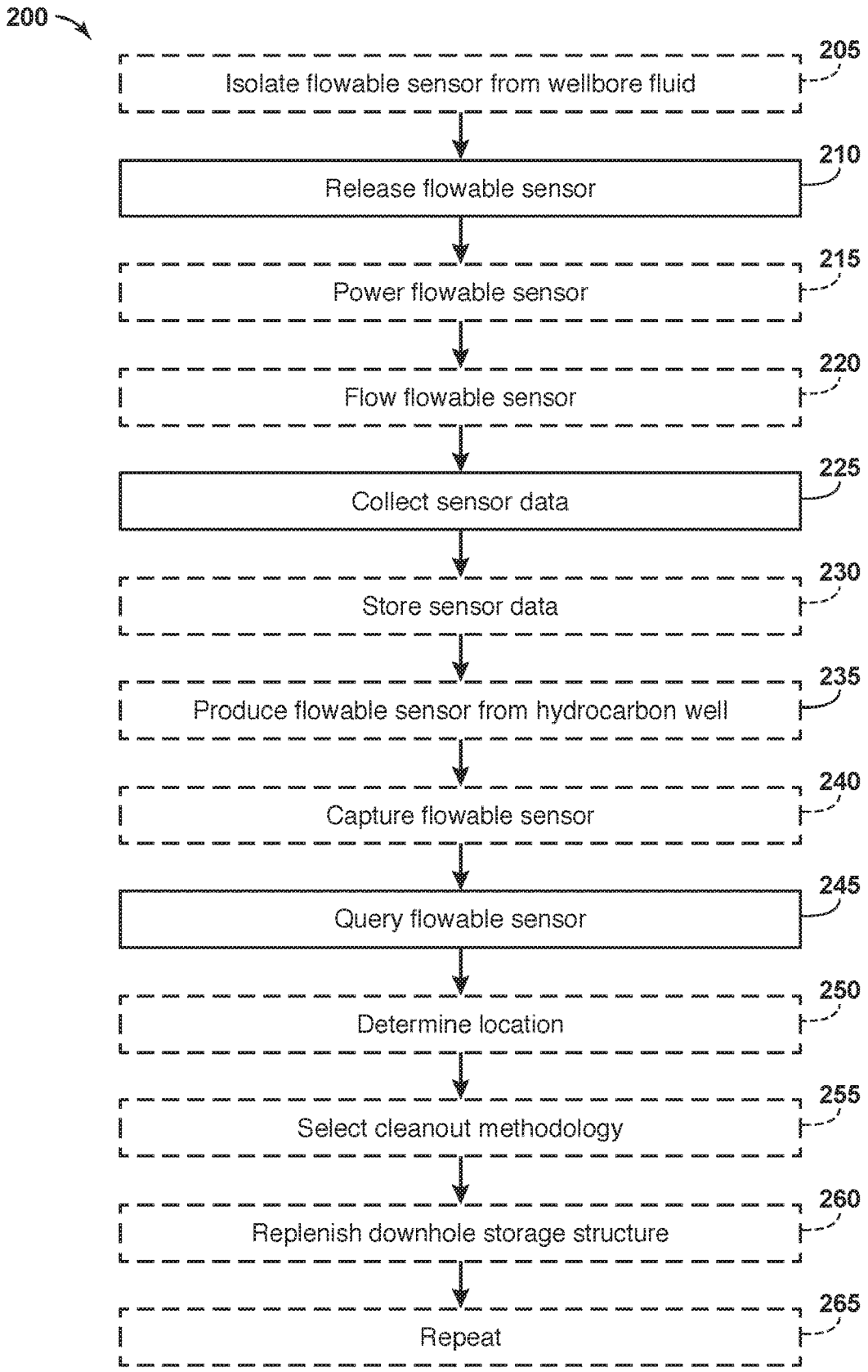
FIG. 3 is a flowchart depicting examples of methods of probing a subsurface region of a hydrocarbon well, according to the present disclosure.

FIGS. 1-3 provide examples of hydrocarbon wells 20 and/or of methods 200 that may include and/or utilize flowable sensors 100, according to the present disclosure. Elements that serve a similar, or at least substantially similar, purpose are labeled with like numbers in each of FIGS. 1-3, and these elements may not be discussed in detail herein with reference to each of FIGS. 1-3. Similarly, all elements may not be labeled in each of FIGS. 1-3, but reference numerals associated therewith may be utilized herein for consistency. Elements, components, and/or features that are discussed herein with reference to one or more of FIGS. 1-3 may be included in and/or utilized with any of FIGS. 1-3 without departing from the scope of the present disclosure.

In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of a hydrocarbon well 20 according to the present disclosure. As illustrated in solid lines in FIG. 1, hydrocarbon wells 20 include a wellbore 30 that extends within a subsurface region 12. Wellbore 30 additionally or alternatively may be referred to herein as extending between a surface region 10 and subsurface region 12 and/or as extending between a surface region 10 and a downhole end region 40 of the hydrocarbon well. As also illustrated in solid lines in FIG. 1, hydrocarbon well 20 includes a downhole sensor storage structure 90. Downhole sensor storage structure 90 may be positioned within downhole end region 40 and may be configured to release a flowable sensor 100 into a wellbore fluid 46 that extends within the wellbore. As also illustrated in solid lines in FIG. 1, hydrocarbon wells 20 include a detection structure 60. Detection structure 60 may be configured to query flowable sensor 100, such as to determine the at least one property of the subsurface region, to receive sensor data indicative of the at least one property of the subsurface region from the flowable sensor, and/or to receive transmitted sensor data 172 that may be based upon the sensor data from the flowable sensor.

As discussed in more detail herein with reference to methods 200 of FIG. 3 and/or during operation of hydrocarbon wells 20, flowable sensor 100 may be released from downhole sensor storage structure 90 and/or into wellbore fluid 46. Subsequent to release of flowable sensor 100 into wellbore fluid 46, the flowable sensor may be configured to collect sensor data indicative of at least one property of the subsurface region. The flowable sensor may move and/or flow, within wellbore 30, such as in an uphole direction 32, and may collect the sensor data during that motion and/or flow. As an example, a produced fluid stream 48 may be produced from the hydrocarbon well, and flowable sensor 100 may be entrained within the produced fluid stream and/or may flow to surface region 10 in and/or within the produced fluid stream.

The sensor data that is collected by the flowable sensor may be received by detection structure 60 and/or may be analyzed to determine the at least one property of the subsurface region. Stated another way, the sensor data that is collected by flowable sensor 100 may be indicative of downhole conditions within the hydrocarbon well, and receipt and/or analysis of this sensor data may provide information about the downhole conditions.

As an example, and as discussed in more detail herein, hydrocarbon well 20 may include an obstruction 70, such as a plug 72 and/or a sand bridge 74. In this example, the sensor data collected by flowable sensor 100 may be indicative of the presence and/or extent of the obstruction. Additional examples of the sensor data that may be collected by the flowable sensor and/or of the at least one property of the subsurface region are disclosed herein.

As illustrated in FIG. 1, hydrocarbon well 20 may include a plurality of downhole sensor storage structures 90, each including a corresponding plurality of flowable sensors 100. Such a configuration may facilitate, or may facilitate more accurate, determination of region(s) of the hydrocarbon well that include obstruction 70. As an example, and when obstruction 70 completely blocks fluid flow therepast, there may be very little, or no, fluid flow within a region of the wellbore that is downhole from the obstruction. As such, a flowable sensor 100 that is released downhole from the obstruction may not flow, or move, within the wellbore and/or toward the surface region. Such a flowable sensor still may, in some examples, communicate with detection structure 60 and/or it may be possible to determine that the obstruction is uphole from the flowable sensor. However, the lack of motion of the flowable sensor may dictate that release of the flowable sensor provides very little quantitative information about a location of the obstruction within the wellbore.

However, when the hydrocarbon well includes another downhole sensor storage structure 90 that is uphole from obstruction 70, flowable sensors 100 that are released from this downhole sensor storage structure may flow within the wellbore and/or toward the surface region. This flow may be relied upon to indicate that obstruction 70 is downhole from this downhole sensor storage structure, thereby identifying a specific region of the wellbore that includes the obstruction.

Downhole sensor storage structure 90 may include any suitable structure that may be positioned within downhole end region 40 of the hydrocarbon well, that may contain at least one flowable sensor 100, and/or that may be configured to release the flowable sensor into wellbore fluid 46. In some examples, downhole sensor storage structure 90 may be configured to maintain flowable sensor 100 in a dry, an at least substantially dry, a fluid-free, an at least substantially fluid-free, a water-free, and/or an at least substantially water-free environment prior to release of the flowable sensor into the wellbore fluid. In some examples, the downhole sensor storage structure may be configured to isolate the flowable sensor from the wellbore fluid prior to release of the flowable sensor into the wellbore fluid. Such a configuration may permit and/or facilitate initiation of sensor data collection, by the flowable sensor, subsequent to fluid contact between the flowable sensor and the wellbore fluid, as discussed in more detail herein.

Downhole sensor storage structure 90 may include, may contain, may house, and/or may be configured to release, or to selectively release, any suitable number of flowable sensors. As an example, the downhole sensor storage structure may include, may contain, and/or may house a plurality of flowable sensors 100. Examples of the plurality of flowable sensors include at least 10, at least 50, at least 100, at least 250, at least 500, at least 1,000, at least 5,000, at most 50,000, at most 25,000, at most 10,000, at most 5,000, at most 1,000, and/or at most 500 flowable sensors. In such a configuration, the downhole sensor storage structure may be configured to release, or to selectively release, any suitable number of flowable sensors into the wellbore fluid at a given point in time and/or to periodically release the suitable number of flowable sensors. Examples of the suitable number of flowable sensors include at least 1, at least 2, at least 3, at least 4, at most 10, at most 8, at most 6, at most 4, and/or at most 2 flowable sensors.

When the suitable number of flowable sensors includes a plurality of flowable sensors, the plurality of flowable sensors may be released for any suitable purpose. As examples, and as discussed in more detail herein with reference to methods 200 of FIG. 3, release of the plurality of flowable sensors may permit and/or facilitate redundant data collection, collection of a greater variety of information regarding downhole conditions and/or properties of the subsurface region, and/or probing of different regions of the hydrocarbon well by different flowable sensors of the plurality of flowable sensors.

It is within the scope of the present disclosure that downhole sensor storage structure 90 may be positioned within hydrocarbon well 20 and/or within downhole end region 40 of wellbore 30 in any suitable manner. As an example, the downhole sensor storage structure may be installed within a casing string and/or within a downhole tubular and may be run, or positioned, into and/or within the hydrocarbon well after drilling of the wellbore. As another example, the downhole sensor storage structure may be installed within the wellbore after casing installation, such as during completion operations that may be performed on the hydrocarbon well. As yet another example, the downhole sensor storage structure may be adhered to an internal surface of the casing string and/or of the downhole tubular.

As illustrated in dashed lines in FIG. 1, downhole sensor storage structure 90 may include a release mechanism 92. Release mechanism 92, when present, may be configured to release, or to facilitate release of, the flowable sensor. Examples of the release mechanism include an electric release mechanism, an electric actuator, a pump, a hydraulic release mechanism, and a mechanical release mechanism. Another example of release mechanism 92 includes a soluble region of the downhole sensor storage structure that may be configured to dissolve upon contact with the wellbore fluid and/or to release the flowable sensor responsive to this dissolution. In such an example, the rate at which the soluble region dissolves may be designed responsive to the desired rate and/or frequency at which the flowable sensors are released responsive to the dissolution. Release mechanism 92 may be configured to release flowable sensor 100 responsive to a release criteria, examples of which are disclosed herein.

Detection structure 60 may include any suitable structure that may be adapted, configured, designed, and/or constructed to query flowable sensor 100, such as to facilitate determination of the at least one property of the subsurface region. Detection structure 60 may be configured to detect any suitable property of flowable sensor 100 and/or to query the flowable sensor in any suitable manner.

As an example, detection structure 60 may be configured to detect an optical identifier of the flowable sensor. In this example, the detection structure may include a light source, which may be configured to illuminate the optical identifier of the flowable sensor, and/or an optical detector, which may be configured to receive an optical signal from the optical identifier.

As another example, detection structure 60 may be configured to detect a radio frequency identifier of the flowable sensor. In this example, the detection structure may include a radio frequency source, which may be configured to excite the radio frequency identifier of the flowable sensor, and/or radio frequency detector, which may be configured to receive a radio frequency signal from the radio frequency identifier.

As yet another example, detection structure 60 may be configured to receive transmitted sensor data 172 from the flowable sensor. In this example, the detection structure may include a wireless receiver, which may be configured to wirelessly receive the transmitted sensor data. Examples of the wireless receiver include a radio frequency receiver, an electromagnetic receiver, and/or a Bluetooth receiver.

In some examples, detection structure 60 may be configured to query flowable sensor 100 while the flowable sensor is positioned within subsurface region 12. An example of such a detection structure 60 includes a downhole wireless network 62. Downhole wireless network 62 may include a plurality of communication nodes 64 that may be spaced-apart along a length of wellbore 30. In such a configuration, each communication node 64 may be configured to communicate with flowable sensor 100, such as to receive the sensor data via receipt of transmitted sensor data 172, and/or may be configured to communicate with at least one other communication node 64, such as to permit and/or facilitate conveyance of the sensor data along the length of the wellbore. In examples of hydrocarbon wells 20 that include detection structure 60 in the form of downhole wireless network 62, receipt of the sensor data while the flowable sensor is positioned and/or flows within the wellbore may permit and/or facilitate observation and/or determination of the at least one property of the subsurface region in real-time.

In some examples, detection structure 60 may include and/or be a surface-based detection structure 66, which may be positioned within surface region 10. In these examples, the surface-based detection structure may be configured to query the flowable sensor as the flowable sensor flows past the detection structure within produced fluid stream 48. Additionally or alternatively, the surface-based detection structure may include a capture structure 68, which may be configured to separate the flowable sensor from the produced fluid stream. In such an example, the detection structure may be configured to query the flowable sensor after the flowable sensor has been separated from the produced fluid stream. Examples of the capture structure include a screen, a filter, and/or a magnetic assembly configured to attract and/or retain the flowable sensor.

As illustrated in dashed lines in FIG. 1, hydrocarbon well 20 may include a downhole tubular 50. Downhole tubular 50, when present, may define a tubular conduit 52, may extend within wellbore 30, and/or may extend from the surface region to the downhole end region of the hydrocarbon well.

As also illustrated in dashed lines in FIG. 1, hydrocarbon well 20 may include a toe sleeve 54. Toe sleeve 54, when present, may be downhole, or in a downhole direction 34, from downhole sensor storage structure 90. Stated another way, the downhole sensor storage structure may be configured to release flowable sensor 100 uphole from, or in uphole direction 32 from, the toe sleeve. Toe sleeve 54, when present, may permit inflow of reservoir fluids into tubular conduit 52, thereby permitting and/or facilitating flow of the reservoir fluids within the tubular conduit, production of the produced fluid stream, and/or flow of the flowable sensor within the produced fluid stream.

As used herein, "uphole direction" 32 may refer to a direction that is directed along a length of the wellbore and toward surface region 10. In contrast, "downhole direction" 34 may refer to a direction that is directed along the length of the wellbore and away from surface region 10. In the present disclosure, a first structure may be referred to as being uphole from a second structure. In this context, the first structure and the second structure may be located within wellbore 30 and/or the first structure may be in uphole direction 32 from, or relative to, the second structure, as measured along the length of the wellbore. Similarly, a third structure may be referred to as being downhole from a fourth structure. In this context, the third structure and the fourth structure may be located within wellbore 30 and/or the third structure may be in downhole direction 34 from, or relative to, the fourth structure, as measured along the length of the wellbore.

As illustrated in solid lines in FIG. 1, hydrocarbon well 20 may include a vertical, or an at least substantially vertical, region 36 that may include and/or define downhole end region 40. As illustrated in dashed lines in FIG. 1, hydrocarbon well 20 may include a horizontal, or a deviated, region 38 that may define a toe region 44 and a heel region 42. In some examples, toe region 44 may be vertically above heel region 42. In these examples, flowable sensor 100 may be neutrally buoyant and/or may be negatively buoyant within wellbore fluid 46. Such a configuration may decrease a potential for the flowable sensor to become entrapped and/or retained within the toe region of the hydrocarbon well.

In some examples, toe region 44 may be vertically below heel region 42. In these examples, flowable sensor 100 may be neutrally buoyant and/or maybe positively buoyant within the wellbore fluid. Such a configuration also may decrease a potential for the flowable sensor to become entrapped and/or retained within the toe region of the hydrocarbon well.

In some examples, horizontal region 38 may include undulations, regions of relatively greater and less depth, and/or "hills" and "valleys." In these examples, flowable sensor 100 may be neutrally buoyant within the wellbore fluid. Such a configuration may decrease a potential for the flowable sensor to become entrapped within a "hill" or "valley."

FIG. 2 is a schematic illustration of examples of flowable sensors 100 that may be included in and/or utilized with hydrocarbon wells 20 and/or methods 200, according to the present disclosure. Flowable sensors 100 that are illustrated in FIG. 2 may include and/or be more detailed illustrations of flowable sensors 100 of FIG. 1. With this in mind, any of the structures, functions, and/or features that are disclosed herein with reference to flowable sensors 100 of FIG. 1 may be included and/or utilized with flowable sensors 100 of FIG. 2 without departing from the scope of the present disclosure. Similarly, any of the structures, functions, and/or features that are disclosed herein with reference to flowable sensors 100 of FIG. 2 may be included in and/or utilized with flowable sensors 100 of FIG. 1 without departing from the scope of the present disclosure.

It is within the scope of the present disclosure that flowable sensor 100 may include any suitable sensor that may be configured to detect one or more properties of the subsurface region of the hydrocarbon well. As examples, flowable sensor 100 may include one or more of a temperature sensor 102, a pressure sensor 104, a pH sensor 106, a resistivity sensor 108, a vibration sensor 110, an acceleration sensor 112, and/or a velocity sensor 114. As another example, the flowable sensor may include a unique identifier 130 that uniquely identifies the flowable sensor. Examples of the unique identifier include a radio frequency identifier and/or an optical identifier. Examples of sensor data that may be collected by each of these sensors and/or of ways in which hydrocarbon well 20 may utilize the unique identifier are disclosed herein with reference to methods 200 of FIG. 3.

In some examples, flowable sensor 100 may include a memory device 160. Memory device 160, when present, may be configured to store sensor data collected by the flowable sensor. Such a configuration may permit and/or facilitate transfer of the sensor data to detection structure 60 of FIG. 1 and/or may permit flowable sensor 100 to collect a plurality of data points prior to transfer of the sensor data to the detection structure. In some examples, memory device 160 may include a clock and/or other timekeeping device. In such a configuration, flowable sensor 100 may be configured to correlate the sensor data to a collection time and/or may be configured to identify, collect, and/or store the sensor data as a function of time, as discussed in more detail herein.

In some examples, flowable sensor 100 may include a data transmitter 170. Data transmitter 170, when present, may be configured to transmit the sensor data to the detection structure. In one example, data transmitter 170 may be configured to generate transmitted sensor data 172, which may be transmitted to and/or may be received by the detection structure. Examples of data transmitter 170 include a wireless transmitter, an electromagnetic transmitter, and/or a Bluetooth transmitter.

In some examples, flowable sensor 100 may include an energy storage device 140. Energy storage device 140, when present, may be configured to power, or to electrically power, the flowable sensor and/or one or more other components of the flowable sensor. Examples of the one or more other components of the flowable sensor include temperature sensor 102, pressure sensor 104, pH sensor 106, resistivity sensor 108, vibration sensor 110, acceleration sensor 112, and/or velocity sensor 114, unique identifier 130, memory device 160, and/or data transmitter 170.

In some examples, flowable sensor 100 may include an initiation structure 150. Initiation structure 150, when present, may be configured to initiate electrical power of the flowable sensor responsive to fluid contact between the flowable sensor and the wellbore fluid. As an example, initiation structure 150 may be configured to resist flow of electric current from energy storage device 140 to the one or more other components of the flowable sensor until after the initiation structure contacts the wellbore fluid. Examples of initiation structure 150 include a dielectric film that is soluble in the wellbore fluid and/or a material that becomes electrically conductive upon fluid contact with the wellbore fluid.

FIG. 3 is a flowchart depicting examples of methods 200 of probing a subsurface region of a hydrocarbon well, according to the present disclosure. Methods 200 may include isolating a flowable sensor from a wellbore fluid at 205 and include releasing the flowable sensor at 210. Methods 200 also may include powering the flowable sensor at 215 and/or flowing the flowable sensor at 220, and methods 200 include collecting sensor data at 225. Methods 200 further may include storing sensor data at 230, producing the flowable sensor from the hydrocarbon well at 235, and/or capturing the flowable sensor at 240, and methods 200 include querying the flowable sensor at 245. Methods 200 also may include determining a location at 250, selecting a cleanout methodology at 255, replenishing a downhole sensor storage structure at 260, and/or repeating at least a subset of the methods at 265.

Isolating the flowable sensor from the wellbore fluid at 205 may include establishing and/or maintaining fluid isolation between the flowable sensor and the wellbore fluid, at least prior to the releasing at 210. Additionally or alternatively, the isolating at 205 may include maintaining the flowable sensor in a dry environment, at least prior to the releasing at 210. As discussed in more detail herein, the isolating at 205 may permit and/or facilitate activation of the flowable sensor and/or initiation of the supply of electric power to one or more components of the flowable sensor responsive to fluid contact between the flowable sensor and the wellbore fluid, such as during the releasing at 210.

Releasing the flowable sensor at 210 may include releasing the flowable sensor from the downhole sensor storage structure and/or into the wellbore fluid. The releasing at 210 may include releasing the flowable sensor within a downhole end region of a wellbore of the hydrocarbon well. The wellbore may extend between a surface region and the downhole end region. Examples of the downhole sensor storage structure, the wellbore, and/or the downhole end region are disclosed herein with reference to downhole sensor storage structure 90, wellbore 30, and/or downhole end region 40 of FIG. 1. Examples of the flowable sensor are disclosed herein with reference to flowable sensors 100 of FIGS. 1-2.

In some examples, and as discussed, the hydrocarbon well may include a toe sleeve. In these examples, the releasing at 210 may include releasing uphole from the toe sleeve. Such a configuration may permit and/or facilitate inflow of wellbore fluid into the hydrocarbon well, production of a produced fluid stream from the hydrocarbon well, entrainment of the flowable sensor within the produced fluid stream, and/or flow of the flowable sensor in the hydrocarbon well and within the produced fluid stream.

In some examples, the downhole sensor storage structure may include, may house, and/or may contain a plurality of flowable sensors. In these examples, the releasing at 210 may include releasing at least one flowable sensor of the plurality of flowable sensors. Additionally or alternatively, the releasing at 210 may include releasing the at least one flowable sensor based upon and/or responsive to a release criteria. Examples of the release criteria include receipt of a sensor release signal by the downhole sensor storage structure, expiration of a threshold sensor release time period, at least one bottom hole condition within the hydrocarbon well being outside a threshold bottom hole condition range, a user indication that the at least one flowable sensor should be released, production of a predetermined volume of produced fluid by the hydrocarbon well, injection of a predetermined volume of injected fluid into the hydrocarbon well, and a pressure within the hydrocarbon well being outside a threshold pressure range.

In some examples, the releasing at 210 may include releasing a single flowable sensor, releasing the single flowable sensor at a given point in time, and/or releasing the single flowable sensor within a given time period. In some examples, the releasing at 210 may include releasing a plurality of flowable sensors, releasing the plurality of flowable sensors at the given point in time, and/or releasing the plurality of flowable sensors within the given time period. In these examples, the querying at 245 may include receiving corresponding sensor data from each flowable sensor of the plurality of flowable sensors. Examples of the plurality of flowable sensors that may be released at the given point in time include at least 2, at least 3, at least 4, at least 5, at least 6, at most 20, at most 15, at most 10, at most 5, and/or at most 3 flowable sensors.

When the releasing at 210 includes releasing the plurality of flowable sensors, each flowable sensor may be configured to detect the same sensor data. Such a configuration may permit and/or facilitate redundant data collection and/or improved data resolution via the plurality of flowable sensors. Additionally or alternatively, at least one flowable sensor in the plurality of flowable sensors may be configured to detect different sensor data from at least one other flowable sensor in the plurality of flowable sensors. Such a configuration may permit and/or facilitate collection of a greater variety and/or breadth of information regarding downhole conditions and/or properties of the subsurface region of the hydrocarbon well.

When the releasing at 210 includes releasing the plurality of flowable sensors, each flowable sensor in the plurality of flowable sensors may have the same, or at least substantially the same, density. Such a configuration may facilitate flow of each flowable sensor in the plurality of flowable sensors within the hydrocarbon well and along similar flow paths and/or trajectories. Alternatively, a first sensor of the plurality of flowable sensors may have a first sensor density that differs from a second sensor density of a second sensor of the plurality of flowable sensors. Such a configuration may permit the plurality of flowable sensors to probe different regions of the hydrocarbon well and/or to take different paths and/or trajectories within the hydrocarbon well. Additionally or alternatively, such a configuration may increase a potential for at least one flowable sensor in the plurality of flowable sensors to reach the surface region and/or to flow from the hydrocarbon well within a produced fluid stream that is produced from the hydrocarbon well. In general, and as discussed, each flowable sensor may be positively, neutrally, and/or negatively buoyant within the wellbore fluid. Furthermore, buoyancy of a given flowable sensor that is released within the wellbore may be selected based upon a configuration of the hydrocarbon well, as also discussed. With this in mind, and when the releasing at 210 includes releasing the plurality of flowable sensors, at least one flowable sensor in the plurality of flowable sensors may be positively buoyant, at least one flowable sensor in the plurality of flowable sensors may be neutrally buoyant, and/or at least one flowable sensor in the plurality of flowable sensors may be negatively buoyant within the wellbore fluid.

In some examples, the releasing at 210 may include releasing with, via, and/or utilizing a release mechanism of the downhole sensor storage structure. Examples of the release mechanism are disclosed herein with reference to release mechanism 92 of FIG. 1.

In some examples, the flowable sensor may include and/or be an electrically powered flowable sensor that includes an energy storage device. In these examples, methods 200 further may include powering the flowable sensor at 215 with the energy storage device. Examples of the energy storage device are disclosed herein with reference to energy storage device 140 of FIG. 2.

In some examples, methods 200 may include initiating the powering at 215 based upon and/or responsive to fluid contact between the flowable sensor and the wellbore fluid. In these examples, the flowable sensor also may include an initiation structure that may be configured to initiate flow of electric current from the energy storage device to at least one other component of the flowable sensor based upon and/or responsive to the fluid contact. Examples of the initiation structure are disclosed herein with reference to initiation structure 150 of FIG. 2.

Flowing the flowable sensor at 220 may include flowing the flowable sensor from the downhole end region, within the wellbore, and/or to the surface region, such as in and/or within the produced fluid stream. This may include flowing the flowable sensor via a tubing conduit that is defined by downhole tubing that extends within the wellbore.

When methods 200 include the flowing at 220, the collecting at 225 may be performed with any suitable timing and/or sequence and/or at any suitable location in and/or within the hydrocarbon well. As examples, the collecting at 225 may be performed during the flowing at 220, the collecting at 225 may be repeatedly performed during the flowing at 220, and/or the collecting at 225 may be periodically performed during the flowing at 220.

Similarly, and when methods 200 include the flowing at 220, the querying at 245 may be performed with any suitable timing and/or sequence and/or at any suitable location in and/or within the hydrocarbon well. As examples, the querying at 245 may be performed during the flowing at 220, the querying at 245 may be repeatedly performed during the flowing at 220, the querying at 245 may be periodically performed during the flowing at 220, and/or the querying at 245 may be performed subsequent to the flowing at 220, such as after the flowable sensor reaches and/or is within the surface region.

Collecting sensor data at 225 may include collecting the sensor data with, via, and/or utilizing the flowable sensor. In some examples, the collecting at 225 may include collecting a single data point with the flowable sensor. In some examples, the collecting at 225 may include a plurality of data points with the flowable sensor. In such examples, the collecting at 225 further may include intermittently, periodically, and/or continuously collecting the sensor data during the collecting at 225.

The collecting at 225 may be performed with any suitable timing and/or sequence during methods 200. As examples, the collecting at 225 may be performed subsequent to the releasing at 210, subsequent to the powering at 215, during the powering at 215, during the flowing at 220, and/or during the producing at 235.

In some examples, the flowable sensor may include a memory device, such as memory device 160 of FIG. 2. In these examples, methods 200 further may include storing sensor data at 230. The storing at 230 may include storing the sensor data that is collected by the flowable sensor and/or that is collected during the collecting at 225. This may include storing the sensor data with, via, and/or utilizing the memory device.

The storing at 230 may be performed with any suitable timing and/or sequence during methods 200. As examples, the storing at 230 may be performed subsequent to the collecting at 225, during the collecting at 225, at least partially responsive to the collecting at 225, during the producing at 235, and/or prior to the capturing at 240.

Producing the flowable sensor from the hydrocarbon well at 235 may include producing, expelling, and/or ejecting the flowable sensor from the hydrocarbon well, or at least from the wellbore of the hydrocarbon well, in any suitable manner. As an example, and as discussed, methods 200, or the producing at 235, may include producing a produced fluid stream from the hydrocarbon well. In this example, the producing at 235 further may include producing the flowable sensor from the hydrocarbon well in and/or within the produced fluid stream.

The producing at 235 may be performed with any suitable timing and/or sequence during methods 200. As examples, the producing at 235 may be performed subsequent to the releasing at 210, subsequent to the powering at 215, during the flowing at 220, responsive to the flowing at 220, during the collecting at 225, subsequent to the collecting at 225, during the storing at 230, subsequent to the storing at 230, prior to the capturing at 240, prior to the querying at 245, and/or during the querying at 245.

Capturing the flowable sensor at 240 may include capturing and/or retaining the flowable sensor in any suitable manner and/or with any suitable structure. As an example, the capturing at 240 may include capturing the flowable sensor with, via, and/or utilizing a capture structure, such as capture structure 68 of FIG. 1. As another example, the capturing at 240 may include separating the flowable sensor from the produced fluid stream, such as to permit and/or to facilitate the querying at 245.

The capturing at 240 may be performed with any suitable timing and/or sequence during methods 200. As examples, the capturing at 240 may be performed during the producing at 235, subsequent to the producing at 235, and/or prior to the querying at 245.

Querying the flowable sensor at 245 may include querying the flowable sensor to determine at least one property of the subsurface region. Stated another way, the querying at 245 may include obtaining the sensor data from the flowable sensor and/or utilizing the sensor data as, to determine, to estimate, and/or to calculate the at least one property of the subsurface region. In some examples, the flowable sensor may include a data transmitter, such as data transmitter 170 of FIG. 2, and/or the hydrocarbon well may include a detection structure, such as detection structure 60 of FIG. 1. In these examples, the querying at 245 may include transmitting the sensor data, or a data stream that is indicative of the sensor data, with the data transmitter and/or to the detection structure.

In some examples, the querying at 245 may include querying the flowable sensor while the flowable sensor is positioned within the subsurface region. In such examples, the querying at 245 may include receiving the data stream from the flowable sensor with, via, and/or utilizing a downhole network, or a downhole wireless network, which may be configured for wireless communication within the wellbore and/or with the flowable sensor. The downhole network may include and/or may form a portion of the detection structure. Examples of the downhole network are disclosed herein with reference to downhole wireless network 62 of FIG. 1. Also in such examples, the querying at 245 may include receiving the data stream in real-time and/or while the flowable sensor is positioned within the wellbore.

The querying the flowable sensor while the flowable sensor is positioned within the subsurface region may be performed with any suitable timing and/or sequence during methods 200. As examples, such querying at 245 may be performed at least partially concurrently with and/or during the powering at 215, the flowing at 220, the collecting at 225, and/or the storing at 230. As another example, such querying at 245 may be performed prior to the producing at 235.

In some examples, the querying at 245 may include querying the flowable sensor while the flowable sensor is, or is positioned within, the surface region. As an example, and when methods 200 include the producing at 235, the querying at 245 may be performed subsequent to the producing at 235. In such examples, the querying at 245 may include querying with a detection structure that is positioned within the surface region.

Also in such examples, and when methods 200 include the capturing at 240, the querying at 245 may be performed subsequent to the capturing at 240.

It is within the scope of the present disclosure that the flowable sensor may be configured to detect any suitable property of the subsurface region. In some examples, the at least one property of the subsurface region may include, may be, and/or may be indicative of a presence of an obstruction within the wellbore, a location of the obstruction within the wellbore, and/or a region of the wellbore that includes the obstruction. Stated another way, the querying at 245 may include receiving transmitted sensor data from the flowable sensor that may be indicative of the presence of the obstruction, the location of the obstruction, and/or the region of the wellbore that includes the obstruction.

As used herein, the word "obstruction" may refer to any partial and/or complete blockage, occlusion, and/or restriction of the wellbore and/or of the tubular conduit. The obstruction may be at least partially formed and/or defined by a buildup, an agglomeration, and/or a collection of debris, scale, proppant, corrosion products, hydrocarbon solids, and/or portions of one or more downhole components. In some examples, the obstruction may include an undissolved, or a portion of a partially dissolved, downhole plug that is positioned within the wellbore. In some examples, the obstruction may be at least partially, or even completely, formed and/or defined by sand. In these examples, the obstruction also may be referred to herein as a sand bridge.

In some examples, the querying at 245 may include lack of receipt of sensor data from the flowable sensor, such as may be caused by loss of the flowable sensor within the wellbore and/or entrapment of the flowable sensor within the wellbore, such as by the obstruction. In these examples, the lack of receipt of the transmitted sensor data may be indicative of the presence of the obstruction, the location of the obstruction, and/or the region of the wellbore that includes the obstruction.

In some examples, the sensor data may include information regarding a location of the flowable sensor within the wellbore. As a more specific example, and when the querying at 245 includes querying with the downhole wireless network, the location of the flowable sensor within the wellbore may be established, estimated, and/or determined based, at least in part, upon a location of a communication node of the downhole wireless network that is in communication with, or that previously has communicated with, the flowable sensor.

In some examples, the flowable sensor may be configured to collect and/or to determine fluid flow properties and/or fluid flow profiles within the wellbore. As examples, the flowable sensor may include and/or be an accelerometer and/or a velocimeter. In some such examples, the sensor data may include an acceleration profile of the flowable sensor as a function of location within the wellbore, and the querying at 245 may include receiving the acceleration profile from the flowable sensor. In some such examples, the sensor data may include a velocity profile of the flowable sensor as a function of location within the wellbore; and/or the querying at 245 may include receiving the velocity profile from the flowable sensor. In some such examples, sensor data includes an acceleration trace of the flowable sensor as a function of time after the releasing; and/or the querying at 245 may include receiving the acceleration trace from the flowable sensor. In some such examples, the sensor data includes a velocity trace of the flowable sensor as a function of time after the releasing, and the querying at 245 may include receiving the velocity trace from the flowable sensor. In some such examples, the sensor data includes a fluid acceleration profile of fluid flow within the wellbore; and/or the querying at 245 may include receiving the fluid acceleration profile from the flowable sensor.

In some such examples, the sensor data may include a fluid velocity profile of fluid flow within the wellbore; and/or the querying at 245 may include receiving the fluid velocity profile from the flowable sensor. The fluid velocity profile may be utilized to calculate, to estimate, to determine, and/or to infer a reservoir inflow profile of reservoir fluids into the wellbore. As a more specific example, and assuming a constant and/or known cross-section for fluid flow within the wellbore, increases in fluid velocity as a function of location within the wellbore and/or as the flowable sensor flows toward the surface region may be attributed to a flow of reservoir fluids into the wellbore. The reservoir inflow profile then may be utilized to quantify reservoir fluid production from various zone(s) of the subsurface region and/or to identify relatively higher producing zones and relatively lower producing zones.

In some examples, the flowable sensor may include a temperature sensor. In these examples, the sensor data may include a temperature profile of the wellbore fluid between the downhole end region and the surface region, and the querying at 245 may include receiving the temperature profile from the flowable sensor.

In some examples, the flowable sensor may include a pressure sensor. In these examples, the sensor data may include a pressure profile of the wellbore fluid between the downhole end region and the surface region, and the querying at 245 may include receiving the pressure profile from the flowable sensor.

In some examples, the flowable sensor may include a pH sensor. In these examples, the sensor data may include a pH profile of the wellbore fluid between the downhole end region and the surface region, and the querying at 245 may include receiving the pH profile from the flowable sensor.

In some examples, the flowable sensor may include a resistivity sensor. In these examples, the sensor data may include a resistivity profile of the wellbore fluid between the downhole end region and the surface region, and the querying at 245 may include receiving the resistivity profile from the flowable sensor.

In some examples, the flowable sensor may include a vibration sensor. In these examples, the sensor data may include a vibration profile of the wellbore fluid between the downhole end region and the surface region, and the querying at 245 may include receiving the vibration profile from the flowable sensor.

In some examples, the flowable sensor may include a unique identifier. The unique identifier may uniquely identify the flowable sensor, such as to distinguish the flowable sensor from another flowable sensor that may be utilized in and/or released into the wellbore. In these examples, the querying at 245 may include detecting the unique identifier. Examples of the unique identifier are disclosed herein with reference to unique identifier 130 of FIG. 2.

Determining the location at 250 may include determining any suitable relative location within the wellbore. The determining at 250 may be accomplished in any suitable manner. As an example, and when the querying at 245 includes querying with, via, and/or utilizing the downhole wireless network, the downhole wireless network may include a plurality of communication nodes that may be spaced-apart along the length of the wellbore. In such an example, the querying at 245 may include querying with a given communication node of the plurality of communication nodes and/or the determining at 250 may include determining a relative location of the flowable sensor within the wellbore based, at least in part, on the given communication node, on a relative location of the given communication node within the wellbore, and/or on a, or an absolute, location of the given communication node within the wellbore.

In some examples, and as discussed, an obstruction may be present and/or positioned within the wellbore. In such examples, the flowable sensor may be trapped and/or retained by the obstruction and/or may not flow past the obstruction within the wellbore. Also in such examples, the determining at 250 may include determining a relative location of the obstruction within the wellbore based, at least in part, on determining that the relative location of the flowable sensor is at least substantially unchanged, such as for at least a threshold retention time. Examples of the threshold retention time include at least 5 seconds, at least 10 seconds, at least 20 seconds, at least 30 seconds, at least 1 minute, at least 5 minutes, and/or at least 10 minutes.

Selecting the cleanout methodology at 255 may include selecting a suitable, any suitable, and/or an advantageous cleanout methodology for the wellbore based upon any suitable information. As an example, the selecting at 255 may include selecting based, at least in part, on the sensor data, as collected during the collecting at 225, on the at least one property of the subsurface region, as determined during the querying at 245, and/or on the relative location of the obstruction, as determined during the determining at 250. Stated another way, methods 200 may provide additional information regarding subsurface conditions within the hydrocarbon well, and this additional information may be utilized, such as by an operator of the hydrocarbon well, to select an appropriate, or a most advantageous, cleanout methodology from a number of available, or accessible, cleanout methodologies that may be performed on the hydrocarbon well. When methods 200 include the selecting at 255, methods 200 further may include performing a cleanout on the hydrocarbon well, with details of the performed cleanout being specified by the cleanout methodology that is selected during the selecting at 255.

Replenishing the downhole sensor storage structure at 260 may include replenishing the downhole sensor storage structure with a new, or with a plurality of new, flowable sensors based upon any suitable criteria. As an example, and as discussed, the downhole sensor storage structure may include, may house, and/or may contain a plurality of flowable sensors. In this example, at least one flowable sensor in the plurality of flowable sensors may include a quantity identifier that indicates when fewer than a threshold number of flowable sensors remain within the downhole sensor storage structure and/or depletion of the supply of flowable sensors from the downhole sensor storage structure. In such an example, the querying at 245 may include detecting the quantity identifier and/or the replenishing at 260 may include replenishing based, at least in part, on the quantity identifier.

The replenishing at 260 may be performed in any suitable manner. As an example, the replenishing at 260 may include inserting the plurality of new flowable sensors into the downhole sensor storage structure while the downhole sensor storage structure is positioned within the wellbore and/or within the downhole end region of the wellbore. As another example, the replenishing at 260 may include retrieving the downhole sensor storage structure from the wellbore and returning a replenished downhole sensor storage structure, which includes the plurality of new flowable sensors, to the downhole end region.

Repeating at least the subset of the methods at 265 may include repeating any suitable subset, step, and/or steps of methods 200 in any suitable manner and/or for any suitable purpose. As an example, the flowable sensor may include and/or be a first flowable sensor of the plurality of flowable sensors that may be included within the downhole sensor storage structure. In such an example, the repeating at 265 may include repeating, intermittently repeating, and/or periodically repeating at least the releasing at 210, the collecting at 225, and the querying at 245. This may include releasing a second flowable sensor, a subsequent flowable sensor, or additional flowable sensors from the downhole sensor storage structure, collecting sensor data with the second flowable sensor, the subsequent flowable sensor, and/or the additional flowable sensor, and querying the second flowable sensor, the subsequent flowable sensor, and/or the additional flowable sensor. Such a configuration may permit and/or facilitate determination of changes in the at least one property of the subsurface region as a function of time, such as may elapse between release of a given flowable sensor and release of a subsequent flowable sensor.

As another example, and as discussed, an obstruction may be present and/or positioned within the wellbore. In such examples, if the releasing at 210 includes releasing the flowable sensor from a downhole sensor storage structure that is downhole from the obstruction, the flowable sensor may be trapped and/or retained by the obstruction and/or may not flow past the obstruction within the wellbore. This may decrease an amount of information that the downhole sensor provides regarding the obstruction and/or a location of the obstruction within the wellbore.

In this example, the repeating at 265 may include repeating the releasing at 210 to release another flowable sensor from another downhole sensor storage structure that is uphole from the obstruction. Also in this example, the repeating at 265 may include repeating the collecting at 225 with the other flowable sensor and repeating the querying at 245 to query the other flowable sensor. Since the other flowable sensor is released uphole from the obstruction, the other flowable sensor may flow within the wellbore and/or toward the surface region. The combination of the information obtained via release of the flowable sensor from the downhole sensor storage structure that is downhole from the obstruction and release of the other flowable sensor from the downhole sensor storage structure that is uphole from the obstruction may permit and/or facilitate more accurate determination of the location of the obstruction within the wellbore.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of probing a subsurface region of a hydrocarbon well, the method comprising:

releasing, from a downhole sensor storage structure and into a wellbore fluid, a flowable sensor within a downhole end region of a wellbore of the hydrocarbon well, wherein the wellbore extends between a surface region and the downhole end region, the downhole sensor storage structure configured to isolate the flowable sensor from the wellbore fluid prior to release of the flowable sensor into the wellbore fluid, wherein the flowable sensor is an electrically powered flowable sensor that includes an energy storage device, and further wherein the method includes powering the flowable sensor with the energy storage device, the flowable sensor being powered by an initiation structure that resists flow of electric current from the energy storage device to another component of the flowable sensor until after the initiation structure contacts the wellbore fluid;

subsequent to the releasing, collecting sensor data with the flowable sensor; and querying the flowable sensor to determine at least one property of the subsurface region of the hydrocarbon well.

2. The method of claim 1, wherein the at least one property of the subsurface region includes at least one of:

(i) a presence of an obstruction within the wellbore;

(ii) a location of the obstruction within the wellbore; and (iii) a region of the wellbore that includes the obstruction.

3. The method of claim 2, wherein the querying includes receiving transmitted sensor data from the flowable sensor, wherein the transmitted sensor data is indicative of at least one of:

(i) the presence of the obstruction within the wellbore;

(ii) the location of the obstruction within the wellbore; and (iii) the region of the wellbore that includes the obstruction.

4. The method of claim 2, wherein the sensor data includes a location of the flowable sensor within the wellbore.

5. The method of claim 1, wherein the flowable sensor includes at least one of an accelerometer and a velocimeter, and further wherein at least one of:

(i) the sensor data includes an acceleration profile of the flowable sensor as a function of location within the wellbore, and further wherein the querying includes receiving the acceleration profile from the flowable sensor;

(ii) the sensor data includes a velocity profile of the flowable sensor as a function of location within the wellbore, and further wherein the querying includes receiving the velocity profile from the flowable sensor;

(iii) the sensor data includes an acceleration trace of the flowable sensor as a function of time after the releasing, and further wherein the querying includes receiving the acceleration trace from the flowable sensor;

(iv) the sensor data includes a velocity trace of the flowable sensor as a function of time after the releasing, and further wherein the querying includes receiving the velocity trace from the flowable sensor;

(v) the sensor data includes a fluid acceleration profile of fluid flow within the wellbore, and further wherein the querying includes receiving the fluid acceleration profile from the flowable sensor; and (vi) the sensor data includes a fluid velocity profile of fluid flow within the wellbore, and further wherein the querying includes receiving the fluid velocity profile from the flowable sensor.

6. The method of claim 1, wherein at least one of:

(i) the flowable sensor includes a temperature sensor, wherein the sensor data includes a temperature profile of the wellbore fluid between the downhole end region and the surface region, and further wherein the querying includes receiving the temperature profile from the flowable sensor;

(ii) the flowable sensor includes a pressure sensor, wherein the sensor data includes a pressure profile of the wellbore fluid between the downhole end region and the surface region, and further wherein the querying includes receiving the pressure profile from the flowable sensor;

(iii) the flowable sensor includes a pH sensor, wherein the sensor data includes a pH profile of the wellbore fluid between the downhole end region and the surface region, and further wherein the querying includes receiving the pH profile from the flowable sensor;

(iv) the flowable sensor includes a resistivity sensor, wherein the sensor data includes a resistivity profile of the wellbore fluid between the downhole end region and the surface region, and further wherein the querying includes receiving the resistivity profile from the flowable sensor; and (v) the flowable sensor includes a vibration sensor, wherein the sensor data includes a vibration within the wellbore fluid between the downhole end region and the surface region, and further wherein the querying includes receiving the vibration profile from the flowable sensor.

7. The method of claim 1, wherein the flowable sensor includes a unique identifier, and further wherein the querying includes detecting the unique identifier.

8. The method of claim 1, wherein the method further includes initiating the powering of the flowable sensor responsive to fluid contact between the flowable sensor and the wellbore fluid.

9. The method of claim 1, wherein the flowable sensor includes a memory device, and further wherein the method includes storing the sensor data collected by the flowable sensor with the memory device.

10. The method of claim 1, wherein the flowable sensor includes a data transmitter, and further wherein the querying includes transmitting the sensor data with the data transmitter.

11. The method of claim 1, wherein the querying includes receiving a data stream from the flowable sensor with a downhole wireless network configured for wireless communication within the wellbore.

12. The method of claim 11, wherein the downhole wireless network includes a plurality of communication nodes spaced-apart along a length of the wellbore, wherein the querying includes querying with a given communication node of the plurality of communication nodes, and further wherein the method includes determining a relative location of the flowable sensor within the wellbore based, at least in part, on a location of the given communication node within the wellbore.

13. The method of claim 12, wherein the method further includes determining the relative location of the obstruction within the wellbore based, at least in part, on determining that the relative location of the flowable sensor is unchanged for at least a threshold retention time.

14. The method of claim 13, wherein the method further includes selecting a cleanout methodology for the hydrocarbon well based, at least in part, on the relative location of the obstruction.

15. The method of claim 1, wherein the method further includes producing the flowable sensor from the hydrocarbon well within a produced fluid stream, and further wherein the querying includes querying the flowable sensor while the flowable sensor is within the surface region.

16. The method of claim 1, wherein the downhole sensor storage structure includes a plurality of flowable sensors, and further wherein the releasing includes releasing at least one flowable sensor of the plurality of flowable sensors responsive to a release criteria.

17. The method of claim 16, wherein the release criteria includes at least one of:

(i) receipt of a sensor release signal by the downhole sensor storage structure;

(ii) expiration of a threshold sensor release time period;

(iii) at least one bottom hole condition within the hydrocarbon well being outside a threshold bottom hole condition range;

(iv) a user indication;

(v) production of a predetermined volume of produced fluid by the hydrocarbon well;

(vi) injection of a predetermined volume of injected fluid into the hydrocarbon well; and (vii) a pressure within the hydrocarbon well being outside a threshold pressure range.

18. The method of claim 1, wherein the flowable sensor is a first flowable sensor, wherein the downhole sensor storage structure includes a plurality of flowable sensors, and further wherein the method includes periodically repeating the releasing, the collecting, and the querying to release additional flowable sensors of the plurality of flowable sensors.

19. The method of claim 1, wherein the initiation structure comprises a dielectric film that is soluble in the wellbore fluid.

20. The method of claim 1, wherein the initiation structure comprises a material that becomes electrically conductive upon fluid contact with the wellbore fluid.

21. A hydrocarbon well, comprising:

a wellbore that extends within a subsurface region, wherein the wellbore extends between a surface region and a downhole end region;

a downhole sensor storage structure positioned within the downhole end region and configured to release a flowable sensor into a wellbore fluid that extends within the wellbore, the downhole sensor storage structure configured to isolate the flowable sensor from the wellbore fluid prior to release of the flowable sensor into the wellbore fluid, wherein the flowable sensor is configured to collect sensor data indicative of at least one property of the subsurface region, wherein the flowable sensor is an electrically powered flowable sensor that includes an energy storage device, and further wherein the method includes powering the flowable sensor with the energy storage device, the flowable sensor being powered by an initiation structure that resists flow of electric current from the energy storage device to another component of the flowable sensor until after the initiation structure contacts the wellbore fluid; and a detection structure configured to query the flowable sensor to determine the at least one property of the subsurface region.

22. The hydrocarbon well of claim 21, wherein the detection structure includes a downhole wireless network configured for wireless communication within the wellbore.

23. The hydrocarbon well of claim 22, wherein the downhole wireless network includes a plurality of communication nodes spaced-apart along a length of the wellbore.

24. The hydrocarbon well of claim 21, wherein the detection structure is positioned within the surface region.

25. The hydrocarbon well of claim 21, wherein the detection structure is configured to query the flowable sensor as the flowable sensor flows past the detection structure within a produced fluid stream that is produced from the hydrocarbon well.

26. The hydrocarbon well of claim 21, wherein the flowable sensor includes at least one of:

(i) a temperature sensor;
(ii) a pressure sensor;
(iii) a pH sensor;
(iv) a resistivity sensor;
(v) a vibration sensor;
(vi) an acceleration sensor; and
(vii) a velocity sensor.

* * * * *